US008075103B2

(12) United States Patent
Furukawa et al.

(10) Patent No.: US 8,075,103 B2
(45) Date of Patent: Dec. 13, 2011

(54) INK JET PRINT HEAD SUBSTRATE AND INK JET PRINT HEAD

(75) Inventors: Tatsuo Furukawa, Zama (JP); Masataka Sakurai, Kawasaki (JP); Nobuyuki Hirayama, Fujisawa (JP); Ryo Kasai, Tokyo (JP); Tomoko Kurokawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/027,123

(22) Filed: Feb. 14, 2011

(65) Prior Publication Data

US 2011/0134192 A1 Jun. 9, 2011

Related U.S. Application Data

(62) Division of application No. 12/145,422, filed on Jun. 24, 2008, now abandoned.

(30) Foreign Application Priority Data

Jun. 27, 2007 (JP) ..... 2007-169632

(51) Int. Cl.
*B41J 2/05* (2006.01)

(52) U.S. Cl. ..... 347/58

(58) Field of Classification Search ..... 347/57–59
See application file for complete search history.

(56) References Cited

U.S. PATENT DOCUMENTS 6,439,690 B2 * 8/2002 Ishinaga et al. ..... 347/48
6,474,789 B1 * 11/2002 Ishinaga et al. ..... 347/59

* cited by examiner

*Primary Examiner* — Matthew Luu
*Assistant Examiner* — Lisa Solomon

(57) ABSTRACT

An ink jet print head substrate is provided which can prevent voltage drop variations during driving, no matter in what way the ejection energy generation elements are driven, and which can also apply a stable energy to the ejection energy generation elements at all times. The ink jet print head substrate of this invention has a plurality of kinds of ejection energy generation elements to generate different magnitudes of ink ejection energy and wiring portions. The print head substrate also has a plurality of wiring layers arranged to at least partly overlap one another. The wiring portions connected to the different kinds of ejection energy generation elements are provided at least partly in different wiring portions.

14 Claims, 17 Drawing Sheets

INK JET PRINT HEAD SUBSTRATE AND INK JET PRINT HEAD

CROSS-REFERENCE TO RELATED APPLICATIONS

This is a divisional of U.S. application Ser. No. 12/145,422 filed Jun. 24, 2008, which claims the benefit of Japanese Patent Application No. 2007-169632, filed Jun. 27, 2007, all of which are hereby incorporated by reference herein in their entirety.

BACKGROUND OF THE INVENTION

1. Field of the Invention

The present invention relates to a substrate installed in an ink jet print head and to an ink jet print head that ejects ink to perform printing.

2. Description of the Related Art

Ink jet printers of recent years are required to form high-resolution images and at the same time print them at higher speed. To meet both requirements—higher resolution of images and faster print speed—one method is available that performs printing at low resolution using large ink droplets in a fast mode and, in a fine mode, performs printing at high-resolution using small ink droplets.

Selecting an optimal print mode on the part of the user to produce a desired image output is very useful. An ink jet print head that realizes this technique is disclosed in Japanese Patent Laid-Open No. 2004-122757.

An ink jet print head disclosed in Japanese Patent Laid-Open No. 2004-122757 (corresponding to U.S. Pat. Nos. 6,966,629 and 7,144,093) has one heater for each nozzle, with first and second heaters arranged alternately in one column extending in a predetermined direction. The first and second heaters can be selectively driven by a select signal, making it possible to produce an image with a wide range of gradation. This ink jet print head drives the first and second heaters of different electric resistances with one and the same power supply. This allows the first and second heaters to use common power supply wires, simplifying a circuit configuration, reducing cost and the size of the head.

FIG. 16 is a plan view of a conventional wiring configuration in an ink jet print head substrate having the first and second heaters arranged alternately in one column, extending in a predetermined direction. In FIG. 16, heaters 103 installed in a base layer 101 each have a first, a second heater, and electrode wires to supply electricity to them. One of wiring portions in each heater 103 is connected to one of power supply side wiring portions 104*a*, 104*b*, 104*c*, 104*d*. The other wiring portion of each heater 103 is connected to a drive element 108 formed of a switching device such as a transistor. The drive element 108 is further connected to common electrodes 105*a*, 105*b*, 105*c*, 105*d* on the grounding side.

Upon receiving a signal from a drive circuit described later, the drive element 108 selectively drives the heaters 103 according to print data to eject ink from the corresponding ejection orifices. The power supply side wiring portions 104*a*, 104*b*, 104*c*, 104*d* and electrodes 105*a*, 105*b*, 105*c*, 105*d* are connected to electrode pads 107, through which they are connected to a power supply and a grounding circuit, respectively. The grounding side electrodes 105*a*, 105*b*, 105*c*, 105*d* and the corresponding power supply side wiring portions 104*a*, 104*b*, 104*c*, 104*d* are constructed so that respective wiring resistances between the grounding side electrodes 105*a*, 105*b*, 105*c*, 105*d* and the corresponding power supply side wiring portions 104*a*, 104*b*, 104*c*, 104*d* are equal to each other. Thus, in this ink jet print head, which has the first heaters and the second heaters 103 of different electric resistances arranged on both sides of an ink supply port 102 as shown in FIG. 16, whichever of the first and second heater is selected, a voltage drop in the wiring portion will not vary either on the power supply side or on the grounding side. This in turn obviates the need to increase the wire width in coping with a voltage drop that would result when the first and second heaters are driven simultaneously, thus allowing for a reduction in the size of the print head.

FIG. 17 is a circuit block diagram of an example conventional ink jet head substrate.

The circuit shown in FIG. 17 has input terminals, such as a heater drive signal input terminal 401, a clock (CLK) input terminal 402, a data input terminal 403, a selection circuit 404, and a latch signal input terminal 405. It also has a heater voltage input terminal 406, a drive circuit 407, a selection data transfer circuit 408, a selection data hold circuit 409, a decoder 410, a data transfer circuit 411, a holding circuit 412, an AND circuit 413, and heaters A, B.

The heaters A, B are the first heater 103 and the second heater 103 shown in FIG. 16. There are m heater groups, each made up of 2n kinds of heaters (in this case, two kinds)—first and second heaters A, B. In each group, the drive circuit 407 and the AND circuit 413 are provided for each of the heaters A, B. The drive circuit 407 drives the heaters A, B according to an output of the AND circuit 413.

In the above circuit, a heater group and a heater kind are chosen according to data entered into the data input terminal 403 and, based on the input data, the first heater A and second heater B are driven. That is, the selected data transfer circuit 408 outputs heater group selection data to the decoder 410 through the selected data hold circuit 409, and also outputs heater kind selection data to the selection circuit 404. Further, the selected data transfer circuit 408 outputs data for printing an image to the data transfer circuit 411. The holding circuit 412 and the data transfer circuit 411 are commonly used by both heaters A and B. Switching between the first heater A and the second heater B is determined by the data entered into the selected data transfer circuit 408 through the data input terminal 403, and a selection of the first or second heater is made by the selection circuit 404.

In FIG. 17, a heater drive power is supplied to the heater voltage input terminal 406. The heater drive power is connected to the ends of the first and second heaters A, B of all groups S(1)-S(m) through a common wire. Input to the data transfer circuit 411 through the selected data transfer circuit 408 is serial image data from the data input terminal 403 that corresponds to each of the groups S(1), S(2), . . . , S(m). Also supplied to the data transfer circuit 411 through the selected data transfer circuit 408 is a clock input signal from the clock input terminal 402 to drive the data transfer circuit. The input image data is then output to the holding circuit 412 as a parallel signal.

The holding circuit 412 is supplied a latch signal through the latch signal input terminal 405. The holding circuit 412 temporarily holds the image data entered from the data transfer circuit 411 before outputting it to the AND circuit 413 for the corresponding group S(1), S(2), . . . , S(m). A drive pulse signal input to the heater drive signal input terminal 401 is supplied to the first heaters A and second heaters B of the groups S(1)-S(m).

As described above, the data input to the selected data transfer circuit 408 from the data input terminal 403 includes, in addition to image data, a signal representing a selection group and kind of heater to be driven. This selection signal is 5-bit long and output to the selected data hold circuit 409. The selected data hold circuit 409 outputs 4 bits of the 5-bit signal received to the decoder 410 and a 1-bit signal representing the kind of heater to be driven to the selection circuit 404.

The decoder 410 has its output terminals divided and connected to each of AND circuits of the groups S(1)-S(m) so that it can determine the group to be connected according to the 4-bit signal received. The selection circuit 404 selects the kind of heater (heater A or B in this case) making up each group. That is, the selection circuit 404 outputs the received 1-bit signal as is to the AND circuit for the first heater A and at the same time inverts the 1-bit signal by an inverter before supplying it to the AND circuit 413 for the second heater B. This prevents the first heater A and the second heater B from being selected simultaneously to ensure that only one of them is selected.

Therefore, the wires for the power supply side wiring portions 104*a*, 104*b*, 104*c*, 104*d* and the grounding side electrodes 105*a*, 105*b*, 105*c*, 105*d*, connected to the associated groups, carry only enough current to drive either the first heater A or second heater B at the same time. The voltage drops caused by the wiring resistances of the individual electrodes are of the same value, which means that power losses due to the wiring resistances are equal for all groups, thus preventing adverse effects on ink ejection characteristics.

It has also been proposed that large ink droplets and small ink droplets are used simultaneously to print an image with high gradation at high speed.

With the print head shown in FIG. 16 and FIG. 17, however, since there is a limitation that the heaters that can be driven simultaneously in each group are only either first or second heater, there remains room for improvement in forming printed images with high gradation.

In forming an image with high gradation, the first and second heaters that eject different volumes of ink may be driven simultaneously to eject large ink droplets and small ink droplets at the same time. That is, by selectively landing large ink droplets and small ink droplets at desired positions, improvements can be made of image quality variations caused by ink droplet size variations, which are caused by head fabrication variations, landing position variations, and mechanical precision variations in a printing apparatus body.

If there is a limitation that only one of the first and second heaters can be driven at a time, a degree of freedom in image design is degraded. That is, under the limitation that the ink droplets that can be ejected simultaneously are only large ink droplets or only small ink droplets, it is not possible to adopt an image design method of improving an apparent image quality by mixing different sizes of ink droplets. So, if such a limitation exists, there is a possibility of not being able to make improvements in image quality above a predetermined level.

Hence, to be able to produce an image with high gradation, a method may be employed that involves entering a selection signal, that can individually distinguish between the first heaters A and second heaters B, into the AND circuit 413. With this method, it is possible to drive the first heaters A and second heaters B individually or simultaneously. In addition to the selection signal, a group selection signal corresponding to each of the first heaters A and second heaters B may be provided. This enables the first heaters A and second heaters B in each group to be driven either individually or simultaneously.

However, in the circuit shown in FIG. 17, the power supply side wiring portions and the grounding side electrodes form common wires for the first and second heaters in the same group. Thus, if the first and second heaters are made individually selectable and if both of them with different electric resistances are driven simultaneously, as described above, a voltage drop occurs in each of the wiring portions connected to the electrodes according to a combined value of currents flowing through the heaters. Thus, a voltage drop occurring in each wire when the first heaters A and second heaters B are driven simultaneously differs from (i.e., is greater than) the one that occurs when the heaters are driven individually or separately.

If arrangements are made so that the first heaters A and second heaters B can be driven individually in each group, a voltage drop caused by a wire resistance varies from one group to another. This means that a resulting power loss differs among different groups, with an energy applied to individual heaters also varying among the groups. Then, the difference in energy applied to individual heaters will result in variations in ink droplet ejection characteristics, rendering ink ejections unstable, which in turn causes a phenomenon of ink droplet landing variations. This is against the object of this method of forming an image with high gradation by using large ink droplets and small ink droplets at the same time.

Under this circumstance, a method is being studied which arranges separately for each heater those wires of the power supply side wiring portions and the grounding side electrodes in each group of the first and second heaters and which sets the wire resistances individually to make them equal.

However, in a print head substrate having first and second heaters alternated or three or more kinds of heaters arranged repetitively, if one tries to connect individual heaters two-dimensionally to the corresponding power supply side wiring portions and grounding side electrodes, the area required for wiring becomes prohibitively large. That is, if the first and second heaters are arbitrarily driven in each group, although voltage drops caused by wiring resistances can be made uniform among different groups, an increase in substrate size and a substantial rise in substrate cost are inevitable.

SUMMARY OF THE INVENTION

The present invention is directed to an ink jet print head substrate which can prevent voltage drop variations during driving, no matter in what way the ejection energy generation elements are driven, and which can also apply a stable energy to the ejection energy generation elements at all times.

A first aspect of the present invention provides an ink jet print head substrate comprising: a plurality of kinds of ejection energy generation elements configured to generate different magnitudes of ink ejection energy, wiring portions configured to energize the ejection energy generation elements, and a plurality of wiring layers disposed to overlap each other at least partly. At least a part of the wiring portions connected to different kinds of the ejection energy generation elements are provided in the different wiring layers.

A second aspect of the present invention provides an ink jet print head having the above ink jet print head substrate, wherein the ejection energy generation elements installed in the ink jet print head substrate are driven to eject ink droplets from ink ejection orifices.

With this invention, in whatever way the ejection energy generation elements are driven, it is possible to prevent voltage drop variations during driving, thus stabilizing the ejection of ink droplets. So, when an image with a high gradation is to be formed by ejecting different sizes of ink droplets, a stable energy can be applied to each ejection energy generation element, ensuring the printing of high quality images. Further, since wiring portions connected to ejection energy generation elements are formed overlapped, the ink jet print head substrate as well as cost can be reduced.

Further features of the present invention will become apparent from the following description of exemplary embodiments (with reference to the attached drawings).

DESCRIPTION OF THE EMBODIMENTS

Now, exemplary embodiments of this invention will be described by referring to the accompanying drawings.

A word "print" signifies forming information, such as letters and figures, whether they are significant or nonsignificant or whether they are latent or visible and perceivable to humans.

What is referred to as "ink" means a liquid that can be applied to a print medium to form images, figures and patterns or process print medium or process ink. The processing of ink includes, for example, coagulating or insolubilizing colorants of ink applied to a print medium.

Figure 1:
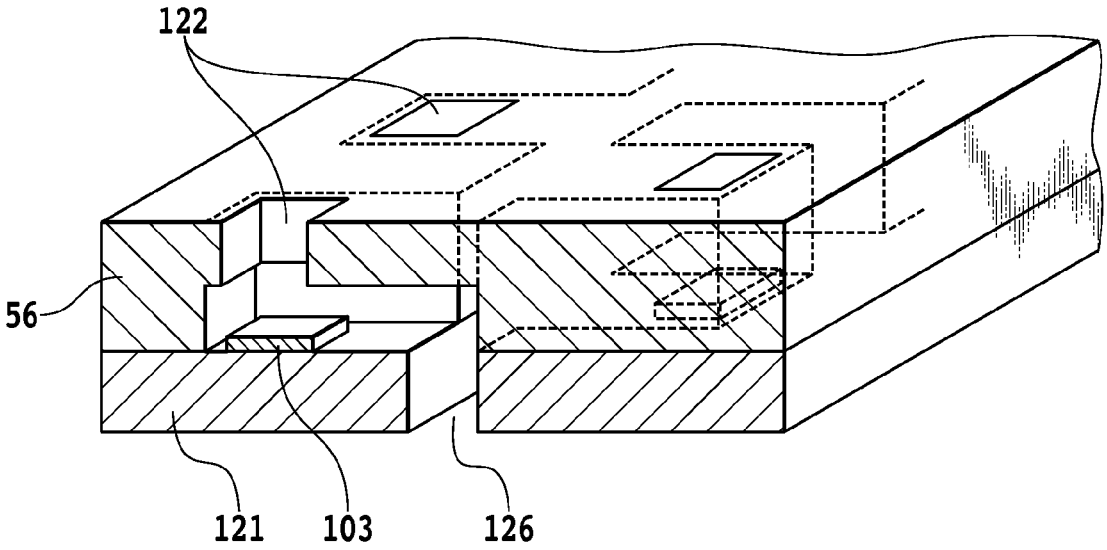
FIG. 1 is a perspective view schematically showing a structure, partly cut away, of an ink jet print head substrate as a first embodiment of this invention.

FIG. 1 is a perspective view schematically showing a construction, partly cut away, of an ink jet print head (also simply referred to as a print head) as a first embodiment of this invention. Referring to FIG. 1, an electrothermal conversion element (heater) 103 is installed in each ink path communicating with an associated ejection orifice 122 to generate an ink ejection energy. These heaters 103 are formed on a surface of a silicon substrate 121 by a process similar to a semiconductor fabrication process. Each heater 103, when applied a predetermined energy by a head drive circuit, causes a status change in ink by film boiling, i.e., form a bubble in ink, to eject an ink droplet from each ejection orifice 122. The print head shown here is of a so-called side shooter type, in which it has ejection orifices 122 formed at positions facing the heaters and ejects ink droplets in a direction perpendicular to the heaters. Reference number 126 denotes an ink supply port to supply ink to the ejection orifices 122 from the back of the silicon substrate/base 121.

Figure 2:
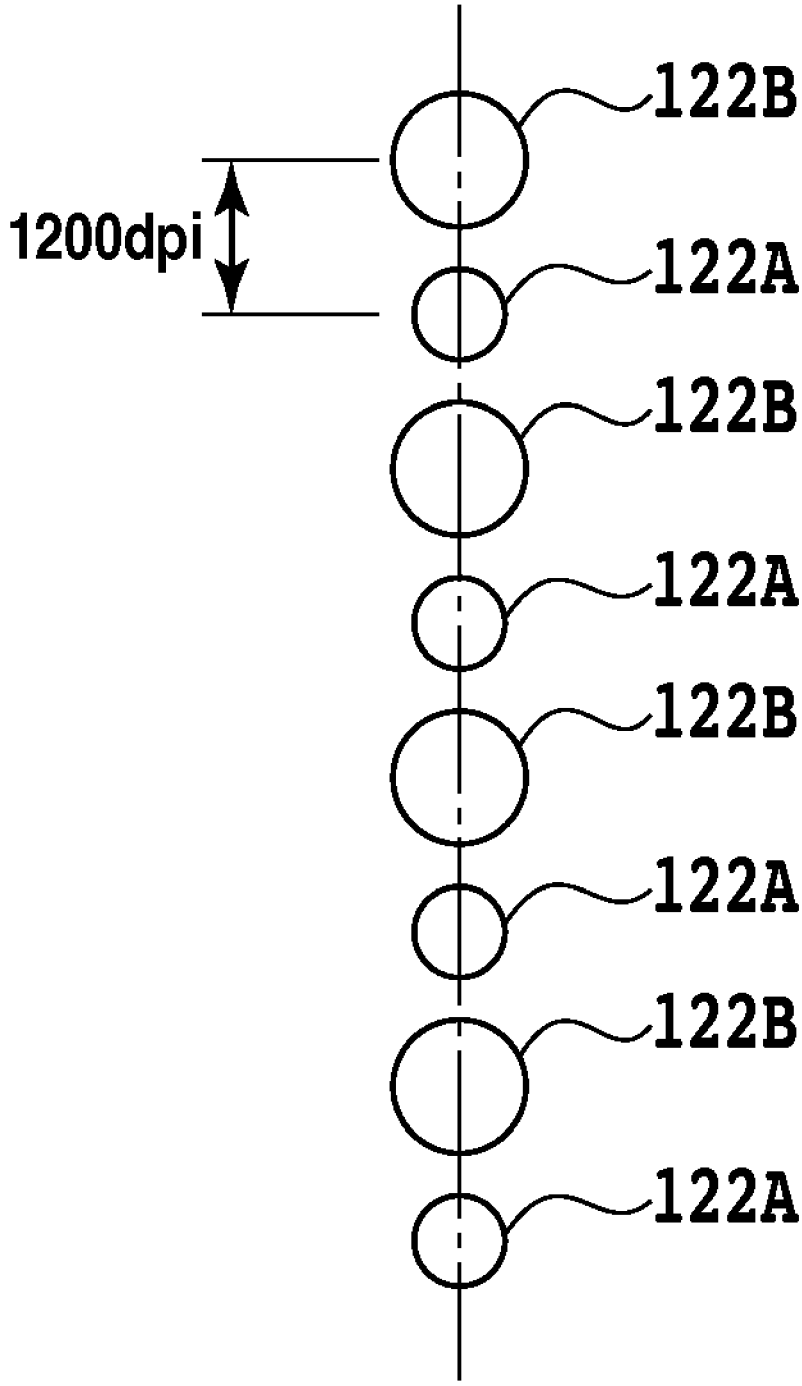
FIG. 2 illustrates an array of ejection orifices formed in a print head of the first embodiment.

FIG. 2 shows an array of ejection orifices 122 in the print head of this embodiment. In this embodiment, large ejection orifices 122B that eject large-volume ink droplets and small ejection orifices 122A that eject small-volume ink droplets are alternated in an array at a predetermined density so that ink droplets of two different sizes, large and small, can be ejected. This embodiment has two such arrays of ejection orifices, arranged one on each side of the ink supply port. The large ejection orifices 122B eject ink droplets of about 5 pl by a first heater described later and the small ejection orifices 122A eject ink droplets of about 2 pl by a second heater. In this specification and the scope of claims, the ink ejection orifice, the ink path communicating with the ink ejection orifice to supply ink from the ink supply port to the ejection orifice, and the heater 103 installed in the ink path are called a "nozzle."

As described above, in this embodiment each ejection orifice array has ejection orifices to eject ink droplets of two different volumes. According to a print mode set by the user, heaters corresponding to the ejection orifices to be used is selected and energized for printing. For example, in a high speed print mode, first heaters (first ejection energy generation elements) are selectively energized to perform ink ejection from large ejection orifices. In a high quality print mode, second heaters (second ejection energy generation elements) are selectively energized to perform ink ejection from small ejection orifices. It is also possible to drive the first and second heaters to eject ink from both of the large and small ejection orifices to print an image with multiple grayscale levels as by an area gradation method.

[Print Head Substrate]

Next, ink jet print head substrates of first to fifth embodiments of this invention will be explained by referring to the accompanying drawings.

First Embodiment

Figure 3:
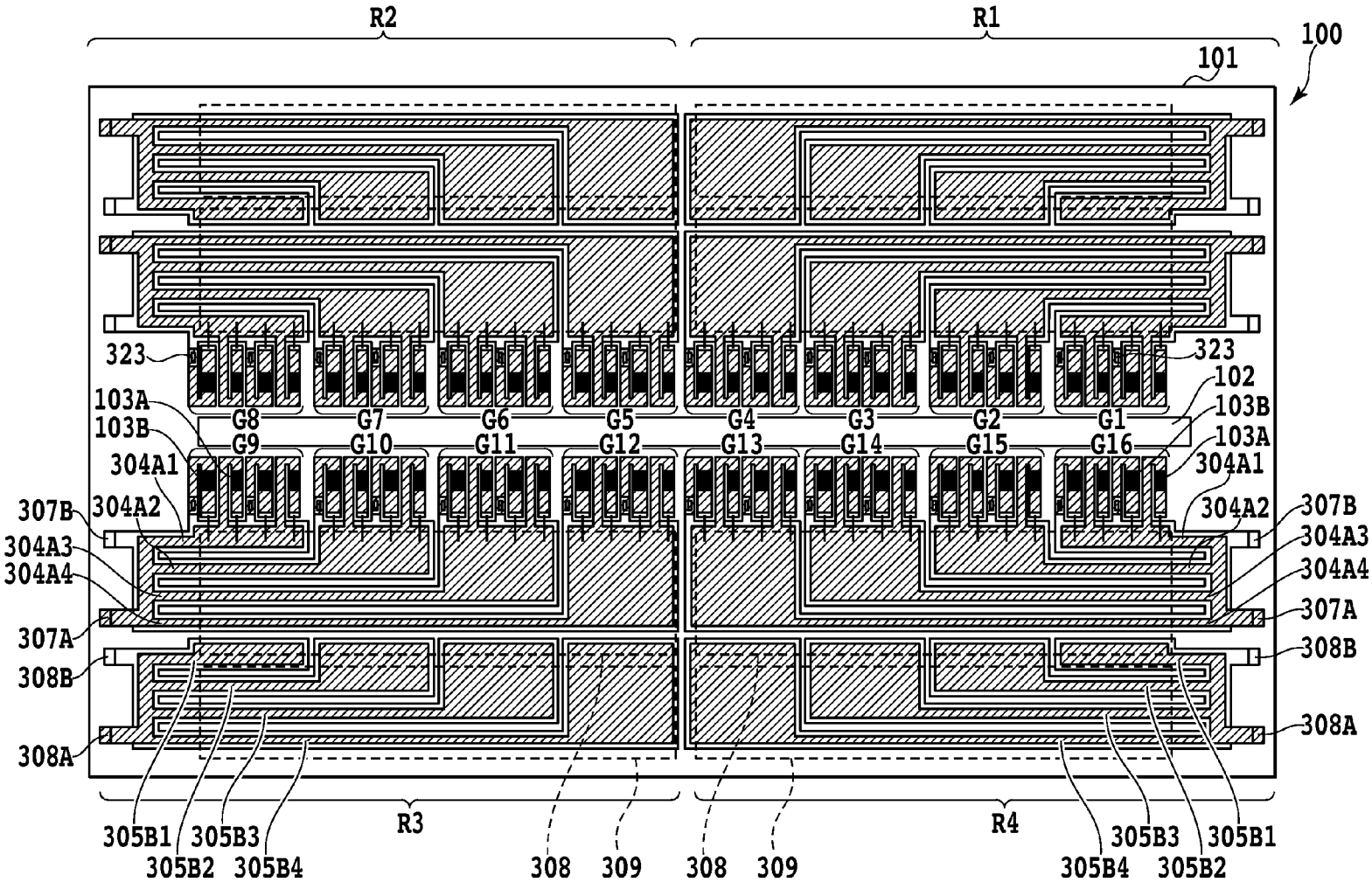
FIG. 3 is a plan view of the ink jet print head substrate of the first embodiment.
Figure 4:
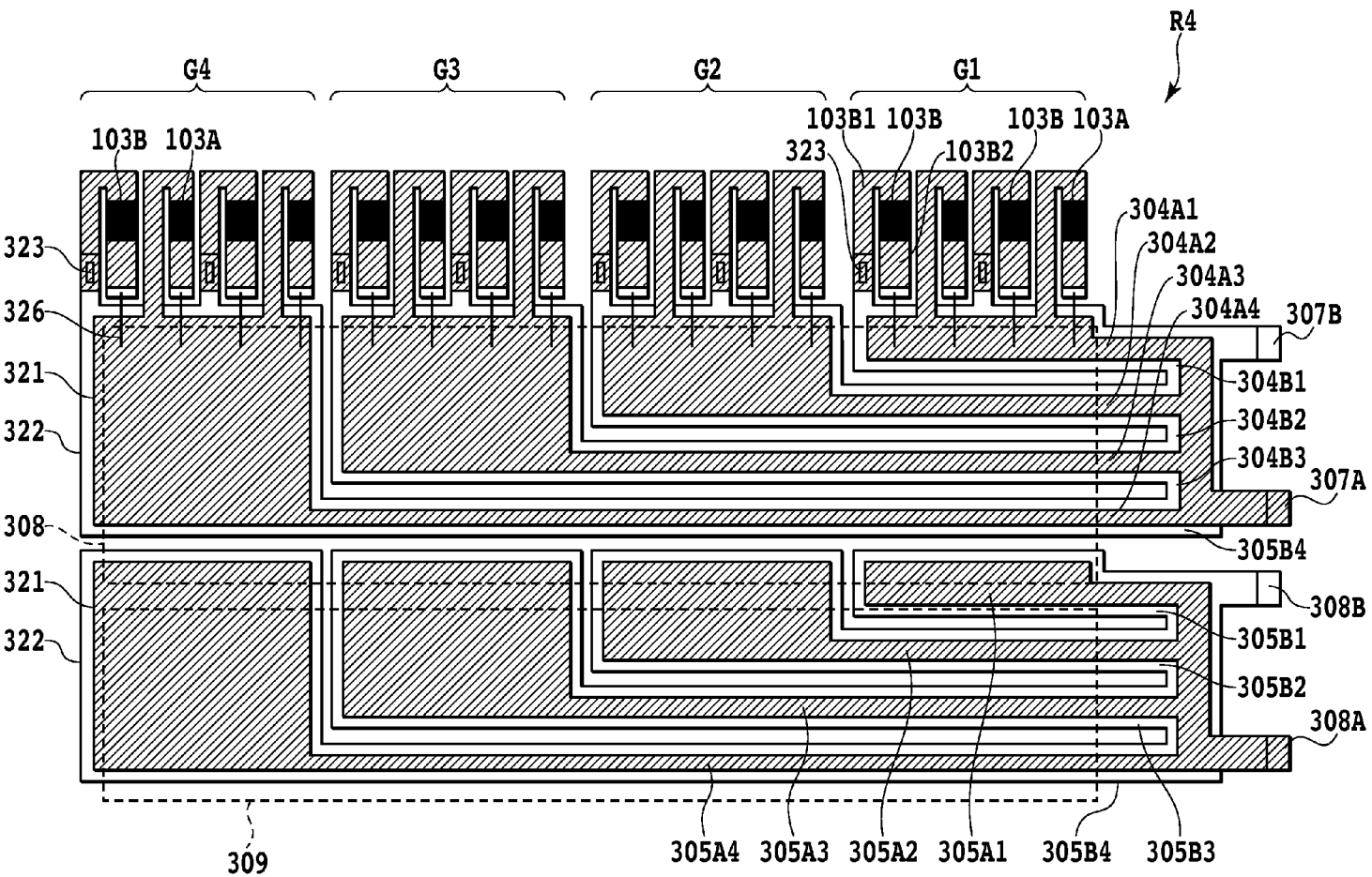
FIG. 4 is an enlarged plan view of a part of FIG. 3.
Figure 5:
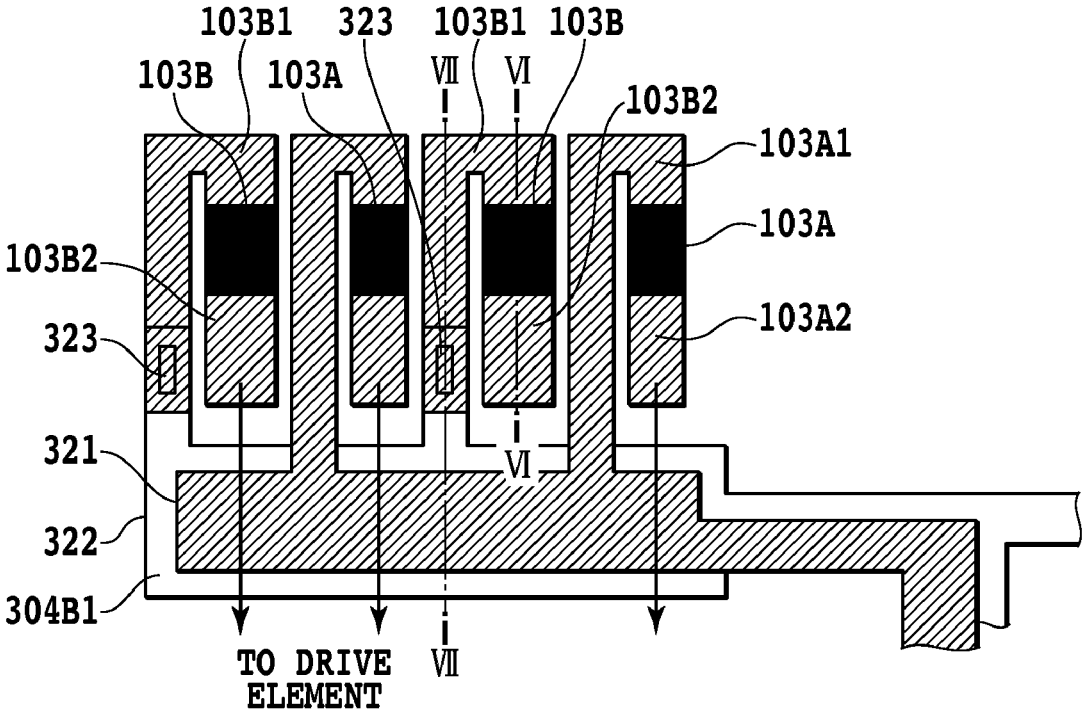
FIG. 5 is a further enlarged plan view showing one of a plurality of groups in FIG. 4.

FIG. 3 is a plan view of an ink jet print head substrate 100 as the first embodiment. FIG. 4 is a partly enlarged plan view of FIG. 3. FIG. 5 is a further enlarged plan view showing one of a plurality of groups in FIG. 4.

The ink jet print head substrate (hereinafter simply referred to as a print head substrate) 100 in this embodiment has four regions R1-R4, each having a plurality of heaters 103 and wiring portions and circuits to energize or supply electricity to these heaters. The regions R1 and R2 are configured almost laterally symmetrical. The regions R3, R4 arranged on each side of the ink supply port 102 are configured almost symmetrical with the regions R2, R1.

In the print head substrate 100 there are two arrays of heaters, one on each side of the ink supply port 102. Each heater array is made up of first heaters 103A for ejecting large-volume ink droplets from the large ejection orifices 122B and second heaters 103B for ejecting small-volume ink droplets from the small ejection orifices 122A, the first and second heaters being alternated in the array. These heaters are divided into a plurality of groups (here, groups G1-G16), each group comprised of a plurality of heaters (2n heaters, where n is an integer). Although each group is shown here to comprise two sets of first and second heaters, it is possible to provide other number of sets of first and second heaters in each group.

In each region of the substrate 1, as shown in FIG. 4, there are provided a first wiring layer 321 (shown shaded), a second wiring layer 322 (shown blank) formed beneath the first wiring layer, and a third wiring layer (not shown) beneath the second wiring layer. Of these layers, the first wiring layer 321 is the one located closest to the ejection orifices 122. In the first wiring layer 321, all the first and second heaters 103A, 103B are formed. Further, in the first wiring layer 321, a part of a wiring portion connected to both ends of the first heaters 103A and a part of wiring connected to both ends of the second heaters 103B are also formed. In the second wiring layer 322, a part of wiring connected to the second heaters 103B is formed. More specifically, the wiring of each heater to the wiring layers 321, 322 are formed as follows.

One end of the first heater 103A is electrically connected to one of the power supply side wiring portions 304A1-304A4 formed in the first wiring layer 321 through one wiring portion 103A1 formed in the first wiring layer 321, as shown in FIG. 3 to FIG. 5. The other end of the first heater 103A is electrically connected to a drive element 308 formed of a transistor as a switching element, through the other wiring portion 103A2 formed in the first wiring layer 321. The drive element 308 is connected to the grounding side wiring portions 305A1-305A4 formed in the first wiring layer 321. Further, the power supply side wiring portions 304A1-304A4 and grounding side wiring portions 305A1-305A4 formed in the first wiring layer 321 are connected to an electrode pad 307A and an electrode pad 308A, respectively. Thus, a power supply device is connected to a grounding circuit (grounding unit) through the electrode pad 307A, the power supply side wiring portions 304A1-304A4, the wiring portion 103A1, the first heaters 103A, the wiring portion 103A2, the drive element 308, the grounding side wiring portions 305A1-305A4, and the electrode pad 308A. Of the wiring from the power supply device to the grounding circuit, the electrode pads 307, the power supply side wiring portions 304A1-304A4, the wiring portion 103A1, the first heaters 103A, the wiring portion A2, and the grounding side wiring portions 305A1-305A4 are formed in the first wiring layer 321.

To one end of the second heater 103B is connected one wring portion 103B1. A part of the one wiring portion 103B1 is electrically connected through a through-hole 323 to one of power supply side wiring portions 304B1-304B4 formed in the second wiring layer 322. As a result, one end of the second heaters 103B is electrically connected to the power supply side wiring portions 304B1-304B4. The power supply side wiring portions 304B1-304B4 and grounding side wiring portions 305B1-305B4 are connected to the electrode pads 307B and 308B, respectively. The power supply device therefore is connected to the grounding circuit through electrode pad 307B, the power supply side wiring portions 304B1-304B4, the through-holes 323, the wiring portion 103B1, the second heaters 103B, the wiring portion 103B2, the drive element 308, the grounding side wiring portions 305B1-305B4, and the electrode pad 308B. Of the wiring from the power supply device to the grounding circuit, the electrode pad 307B and the power supply side wiring portions 304B1-304B4 are formed in the second wiring layer 322 and the wring portion 103B1, the second heaters 103B and the wiring portion 103B2 are formed in the first wiring layer 321.

The drive element 308 is connected to a selection circuit 309 that selectively drives the heaters 103A, 103B by using a third wiring layer (not shown) formed beneath the second wiring layer 322.

At this time, the electrical resistances of the wiring portions connected to heaters are set equal. This can be accomplished by adjusting a wire width of each wiring portion. For example, in FIG. 4, the power supply side wiring portions 304A1-304A4 and 304B1-304B4 of each group G1-G4 have different lengths from their ends (connected positions with the heater 103A and 103B) to the electrode pads 307A, 308A. So, in this embodiment the wire widths of the electrode side wiring portions are increased by an amount corresponding to their lengths. This makes the electric resistances of the electrode side wiring portions equal among different groups. This setting also applies to the grounding side wiring portions 305A1-305A4 and 305B1-305B4.

Figure 17:
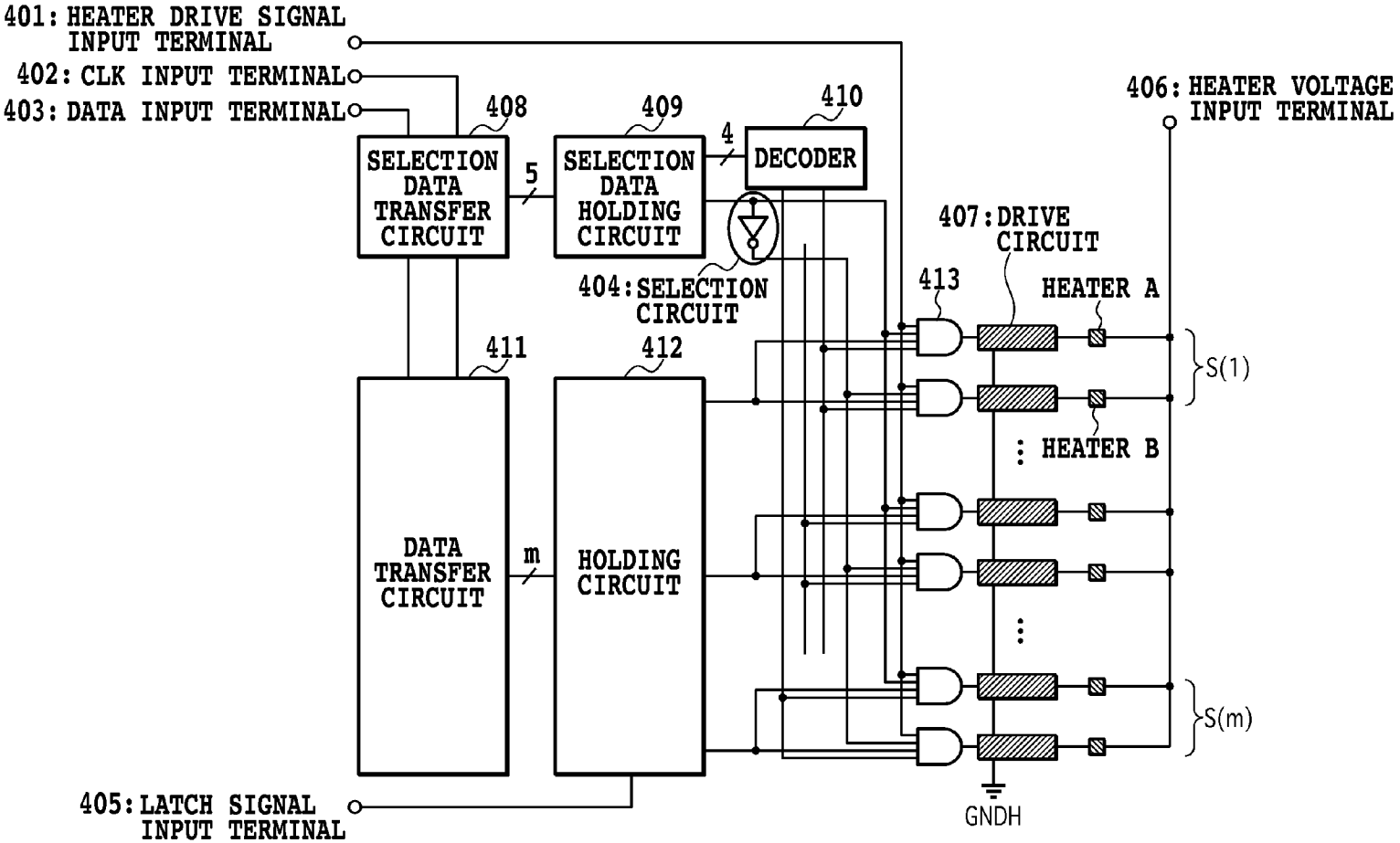
FIG.17 PRIOR ART
FIG. 17 is an example circuit block diagram for the conventional ink jet print head substrate.

For the drive element and the drive circuit in this embodiment, a variety of kinds including ones shown in FIG. 17 may be used as long as they can selectively drive individual heaters 103 according to print data.

As described above, since the ink jet print head of this embodiment has the first heaters and the second heaters formed in different wiring layers, if both heaters are simultaneously energized, electric currents flowing through them do not adversely affect each other. Further, since the electric resistances of individual wires are the same, voltage drops occurring in these wires are also equal. Thus, whether the first and second heaters are driven separately or simultaneously in each group, voltage drop differences will not be caused among different groups, ensuring that appropriate electric energy will be applied to individual heaters at all times.

Figure 6:
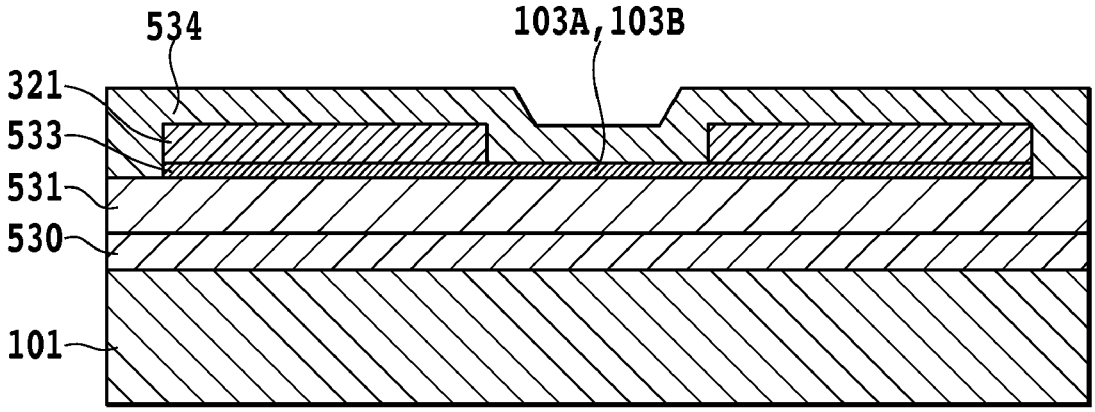
FIG. 6 is a cross-sectional view taken along the line VI-VI of FIG. 5.
Figure 7:
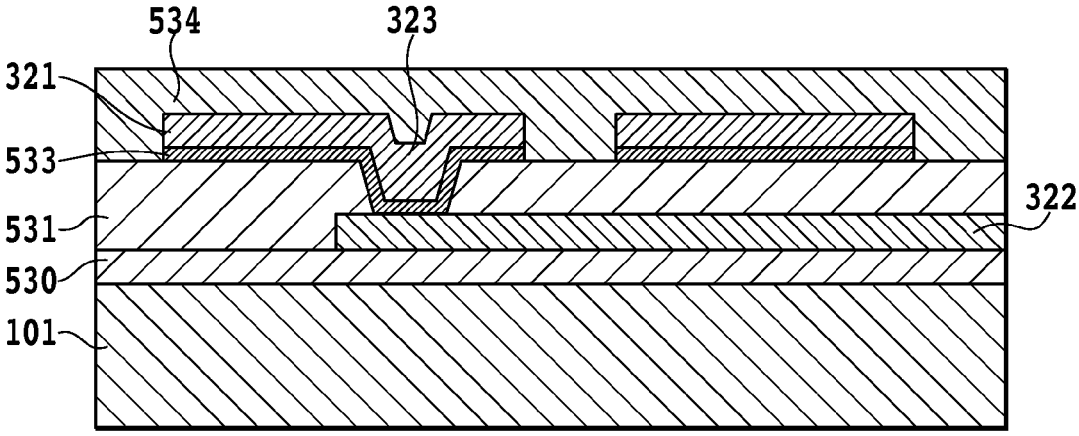
FIG. 7 is a cross-sectional view taken along the line VII-VII of FIG. 5.

A cross-sectional construction of the ink jet print head substrate in this embodiment will be explained by referring to FIG. 6 and FIG. 7. FIG. 6 and FIG. 7 are cross sections taken along the line VI-VI and VII-VII of FIG. 5. As shown in FIG. 6, over a silicon base layer 101 is laid an insulating layer 530. The insulating layer 530 includes a plurality of insulating films between the drive element and the drive circuit and their overlying wiring layer. Reference number 321 denotes a first wiring layer, and what is designated 533 is a heater layer that is formed along with the first wiring layer 321. By selectively eliminating the first wiring layer 321 to expose the heater layer 533, the first heaters 103A and the second heaters 103B are formed. Reference number 531 denotes an interlayer insulating layer between the heater layer and a second wiring layer 322 described later. Reference number 534 denotes a protective layer formed over the first wiring layer 321.

In FIG. 7, reference number 322 denotes a second wiring layer. The second wiring layer is isolated from the first wiring layer 321 by the interlayer insulating layer 531 at other than the through-holes 323. It is connected to the first wiring layer 321 via the through-holes 323. Thus, a current flowing through the wiring including the second heaters 103B flows from the first wiring layer 321 to the second wiring layer 322 through the through-holes 323 and therefore is isolated from a current flowing through the wiring including the first heaters 103A. As a result, whether the first heater 103A and the second heater 103B are driven simultaneously or separately, voltage drops occurring in the wiring portions connected to the individual heaters do not affect one another. Therefore, whether the first and second heaters are driven separately or simultaneously in each group, voltage drop differences will not be caused among different groups, making it possible to apply an appropriate electric energy to individual heaters at all times. This in turn allows appropriate sizes of ink droplets to be ejected from individual ejection orifices either in a print mode that ejects only large ink droplets or small ink droplets or in a print mode that ejects different sizes of ink droplets simultaneously to form an image with high gradation. Therefore, in either print mode, it is possible to print an image conforming to the print mode, achieving high reliability.

In this embodiment, the wiring portion connected to the first heater and most of the wiring portion connected to the second heater are arranged three-dimensionally, overlapping one upon the other. With this embodiment, therefore, the wiring portions connected to heaters can be reduced in plan-view size on the substrate, compared with the conventional construction in which the wiring portions are two-dimensionally arranged on the same plane. The construction of this embodiment therefore can reduce the size of the print head.

Further, in this embodiment the heater layer 533 is formed simultaneously with the first wiring layer 321 and thus laid over the second wiring layer 322, i.e., on the upper side of the second wiring layer 322. This construction can enhance an efficiency of heat conduction from the heater layer 533 to the ink droplets being ejected. This embodiment therefore can be said to provide an optimal construction.

While in this embodiment the first heater and the second heater are alternated every single heater, a plurality of consecutive heaters of one type may be alternated with the corresponding number of the second type heaters. In this case too, the similar effects to those of the embodiment can be expected.

Second Embodiment

Figure 8:
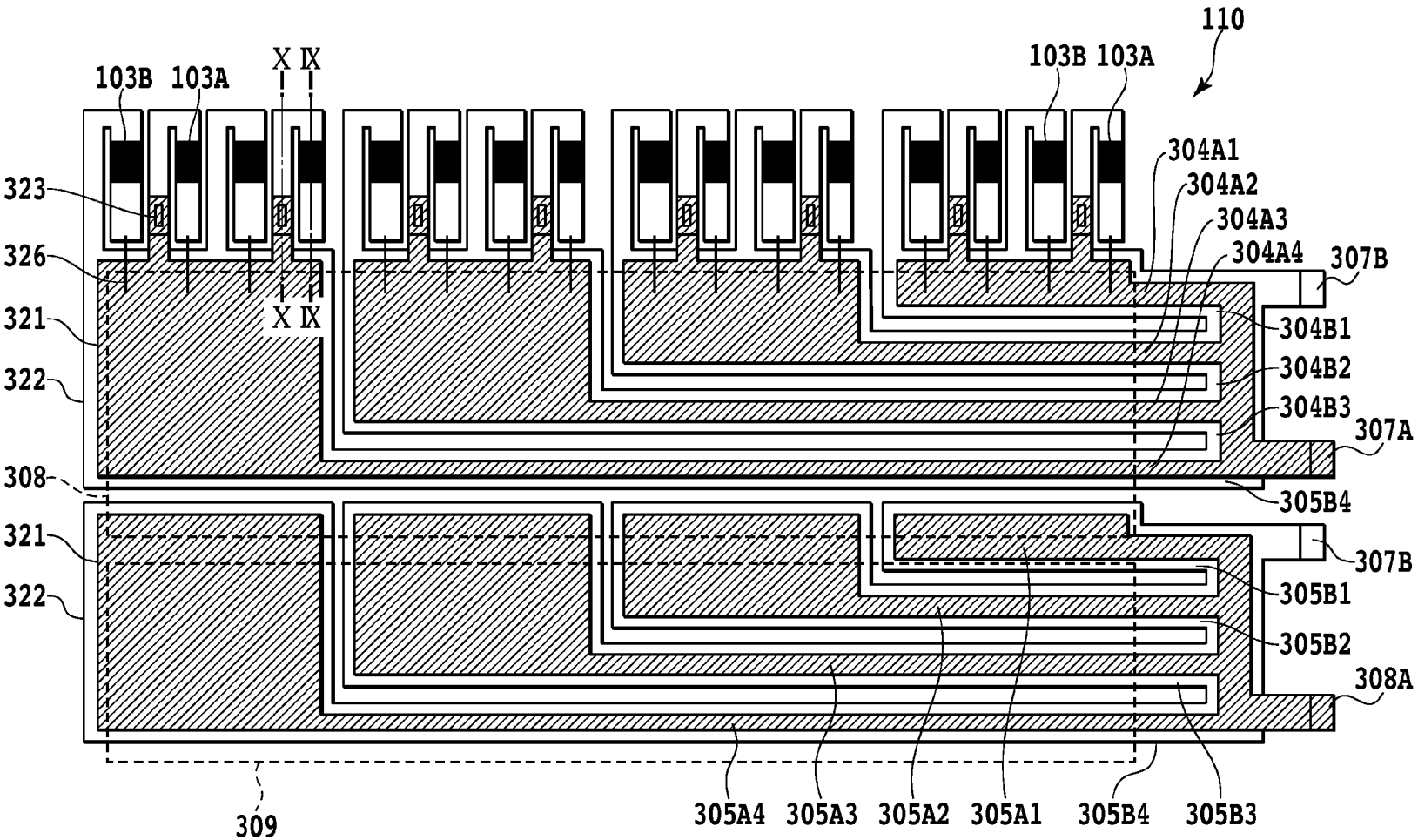
FIG. 8 is a plan view showing an ink jet print head substrate as a second embodiment of this invention.
Figure 9:
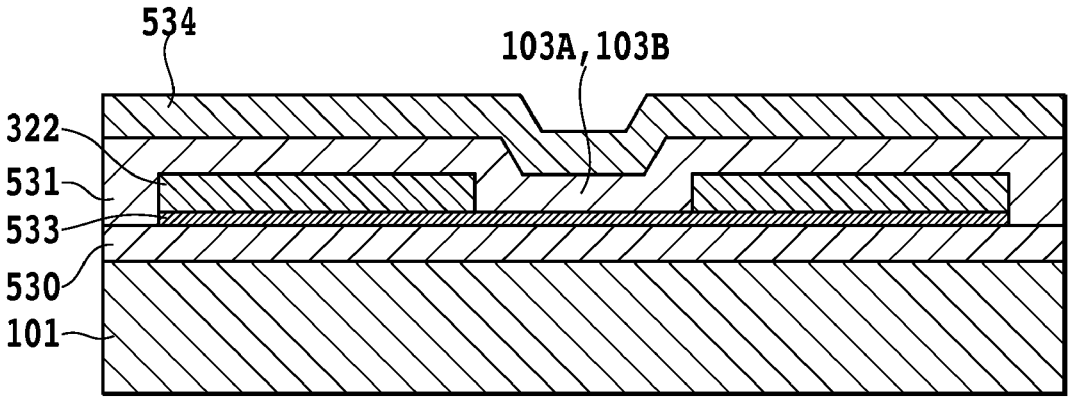
FIG. 9 is a cross-sectional view taken along the line IX-IX of FIG. 8.
Figure 10:
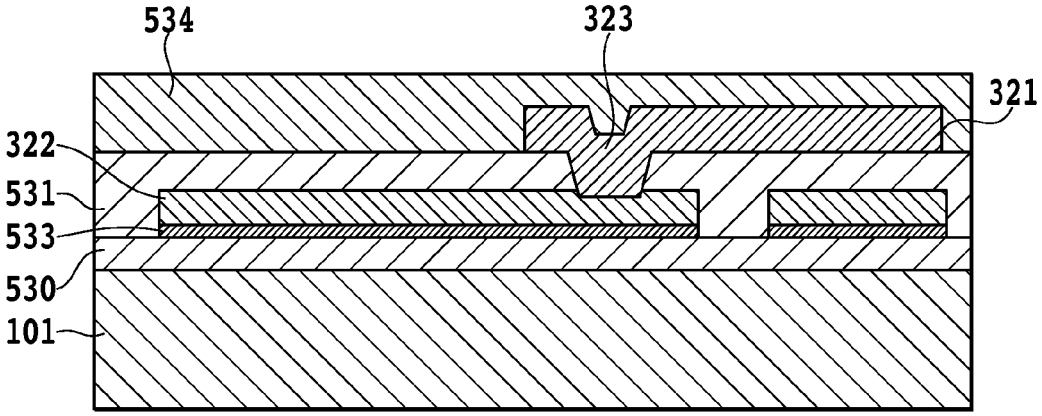
FIG. 10 is a cross-sectional view taken along the line X-X of FIG. 8.

Next, an ink jet print head substrate as a second embodiment of this invention will be explained by referring to FIG. 8 to FIG. 10. FIG. 8 is a plan view of the ink jet print head substrate of this embodiment. FIG. 9 is a cross section taken along the line IX-IX of FIG. 8. FIG. 10 is a cross section taken along the line X-X of FIG. 8. In FIG. 8, parts identical with or equivalent to the corresponding parts of FIG. 4 are given like reference numbers and their detailed explanations are omitted.

The substrate 110 shown in FIG. 8 has heaters 103A, 103B formed in the second wiring layer 322, with the first wiring layer 321 connected via through-holes 323 to the first heaters 103A.

As shown in cross sections of FIG. 9 and FIG. 10, reference numeral 533 represents a heater layer formed together with the second wiring layer 322. The heater layer 533 is exposed by selectively eliminating the second wiring layer 322 to form the heaters 103A, 103B. In this case, a current supplied from the electrode pad 307A to the power supply side wiring portions 304A1-304A4 formed in the first wiring layer 321 flows via the through-holes 323 to the wiring including the first heaters 103A. This configuration can isolate the current flowing in the heaters 103B from current flowing in the power supply side wiring portions 304A1-304A4 connected to the heaters 103A by the first wiring layer and the second wiring layer. Thus, in this embodiment also, similar effects to those of the first embodiment can be produced.

Third Embodiment

Figure 11:
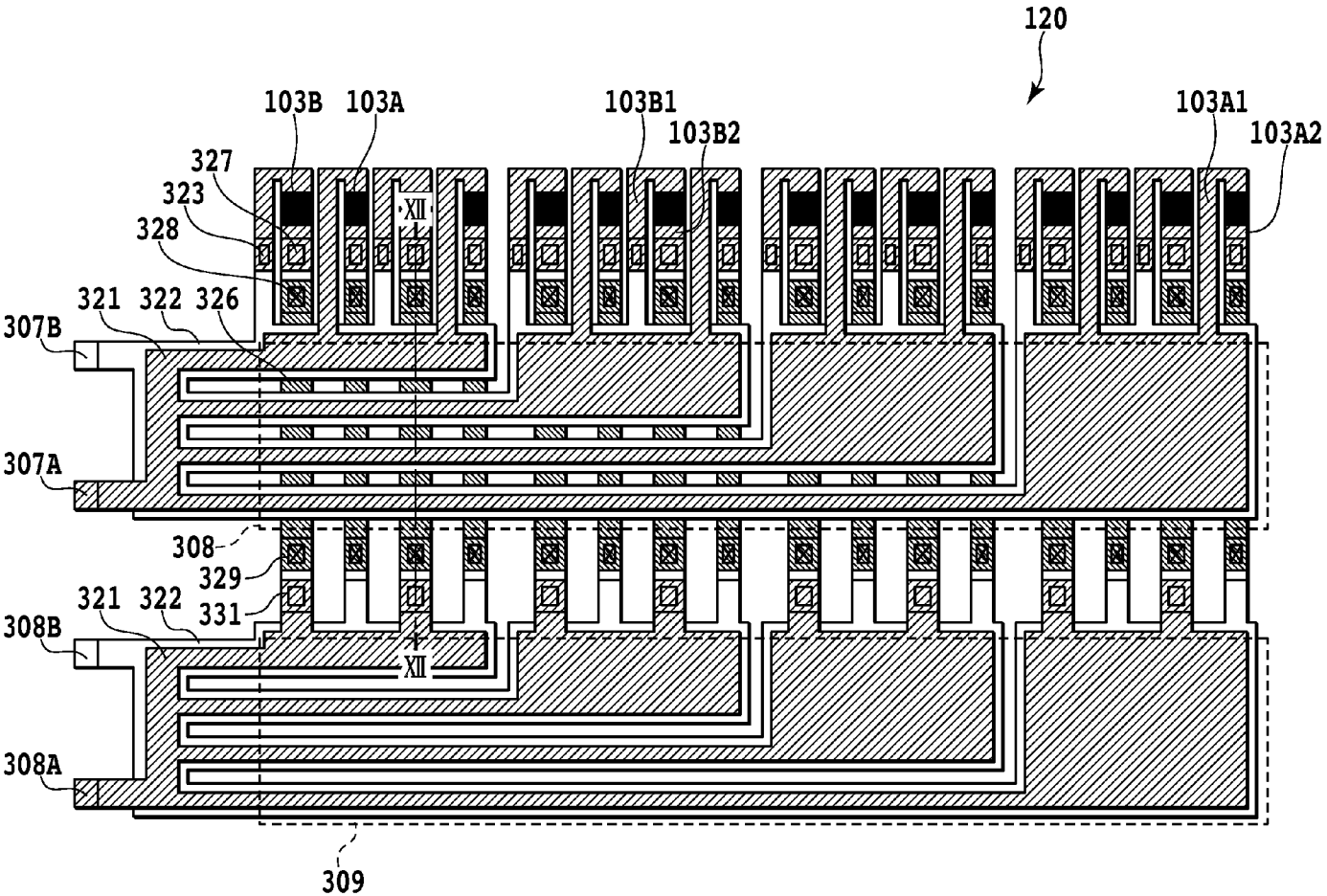
FIG. 11 is a plan view showing an ink jet print head substrate as a third embodiment of this invention.

Next, an ink jet print head substrate 120 as a third embodiment of this invention will be explained by referring to a plan view of FIG. 11 and a cross-sectional view of FIG. 12 taken along the line XII-XII of FIG. 11. In FIG. 11, parts identical with or equivalent to the corresponding parts of FIG. 4 are given like reference numbers and their detailed explanations are omitted.

The print head substrate 120 of this embodiment has the first wiring layer 321 connected to the second wiring layer 322 via a first through-hole 327 in order to connect wiring portions 103A2, 103B2 at one end of each of the first and second heaters 103A, 103B to drive element 308. The second wiring layer 322 is connected via a second through-hole 328 to a third wiring layer 326 which is disposed beneath the second wiring layer 322. The third wiring layer 326 is one directly connected to the drive element 108.

To supply a current to individual heaters requires connecting the drive element 308 to one end (electrode) of each heater. It is noted that the layer directly connected to the drive element 308 is the third wiring layer 326. Thus, connection between one terminal of each heater and the drive element 308 requires connection from the first wiring layer 321 up to the third wiring layer 326. Here, rather than directly connecting the first wiring layer 321 to the third wiring layer 326, a step-by-step connection method is employed which involves connecting the first wiring layer 321 to the second wiring layer 322 and then connecting the second wiring layer 322 to the third wiring layer 326. At this time, the second through-hole 328 to connect the second wiring layer 322 to the third wiring layer 326 is disposed closer to the drive element 308 than the first through-hole that connects the first wiring layer 321 to the second wiring layer 322.

Further, the similar connections are made for the first and second wiring layers (wiring layers on the right side in FIG. 12) 321 and 322 connected to the grounding side terminal (electrode) of the drive element 308. This is done by a step-by-step process of first connecting the first wiring layer 321 to the second wiring layer 322 and then connecting second wiring layer 322 to the third wiring layer 326. Further, a second through-hole 329 is disposed at a position closer to the drive element 308 than a first through-hole 331.

Figure 12:
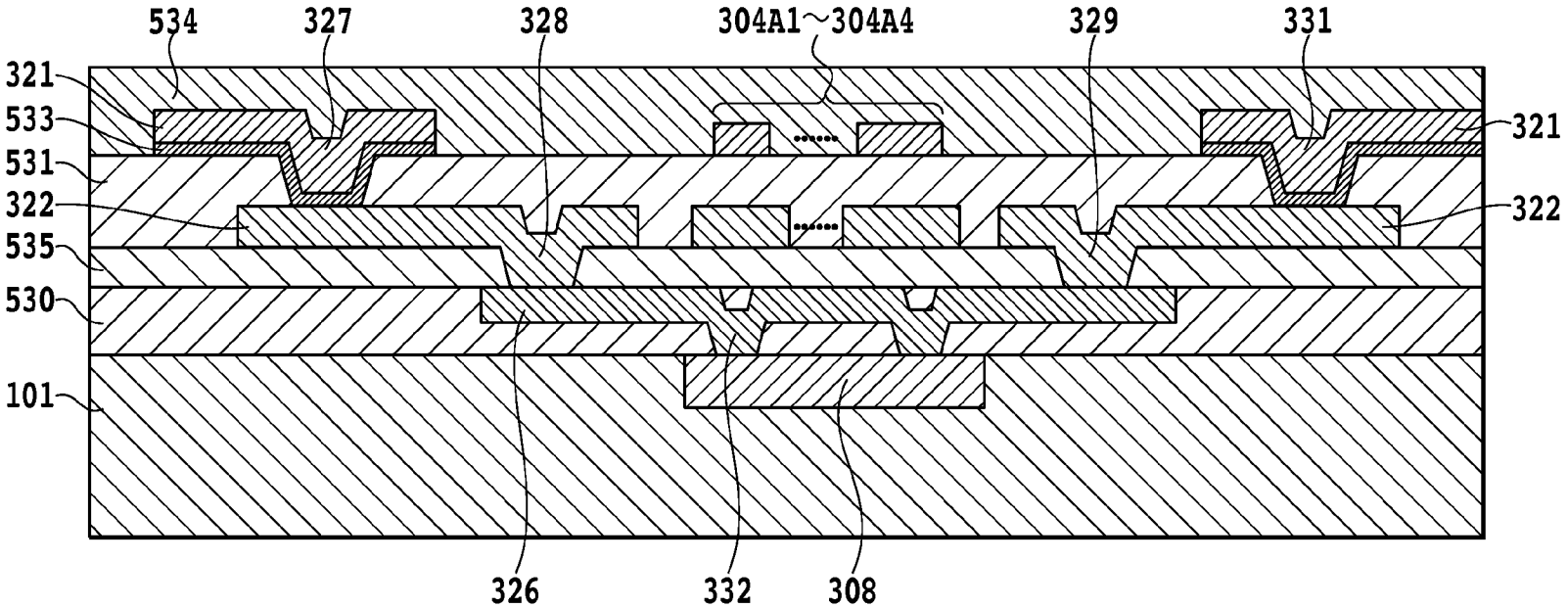
FIG. 12 is a cross-sectional view taken along the line XII-XII of FIG. 11.

In FIG. 12, reference number 531 denotes a first interlayer insulating layer disposed between the first wiring layer 321 and the second wiring layer 322. Reference number 535 denotes a second interlayer insulating layer disposed between the second wiring layer 322 and the third wiring layer 326. The drive element 308 is constructed of transistors formed in the silicon base layer 101. The third wiring layer 326 is directly connected to the drive element 308 through a contact hole 332.

By disposing the second through-holes 328 and 329 closer to the drive element than the first through-holes 327 and 331, wire lengths can be made the shortest possible when the step-by-step wiring connection is performed. As a result, a highly efficient layout can be obtained in reducing the overall substrate size. Further, since the layer structure ranging from the first wiring layer 321 to the drive element 308 is formed like stairs, vertical height differences among the layers can be alleviated. The construction of this embodiment is shown to have the heater layer 533 formed simultaneously with the first wiring layer and laid over the second wiring layer 322. With the wiring layer including the heater layer 533 disposed over the second layer (i.e., closer to ejection orifices than the second layer), the efficiency of heat conduction from the heater layer 533 to ink droplets being ejected can be enhanced. This embodiment therefore can be said to have an optimal configuration in terms of heat conduction efficiency. Furthermore, since the layer structure ranging from the first wiring layer to the drive element rises progressively like stairs, vertical height differences among the layers can be alleviated, which in turn prevents a possible degradation in yield due to etch residues left during fabrication process, thus providing an inexpensive substrate.

Fourth Embodiment

Figure 13:
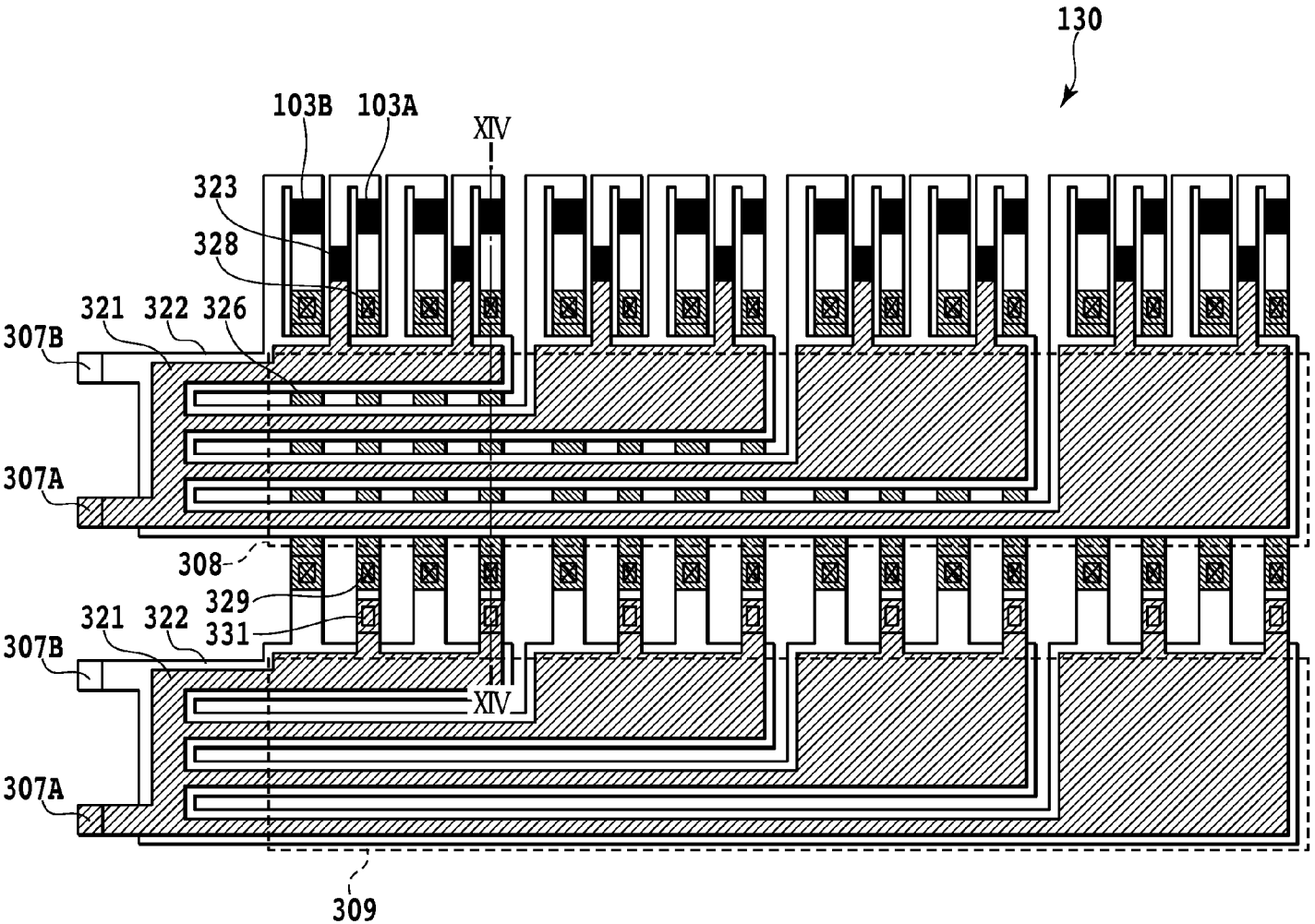
FIG. 13 is a plan view showing an ink jet print head substrate as a fourth embodiment of this invention.
Figure 14:
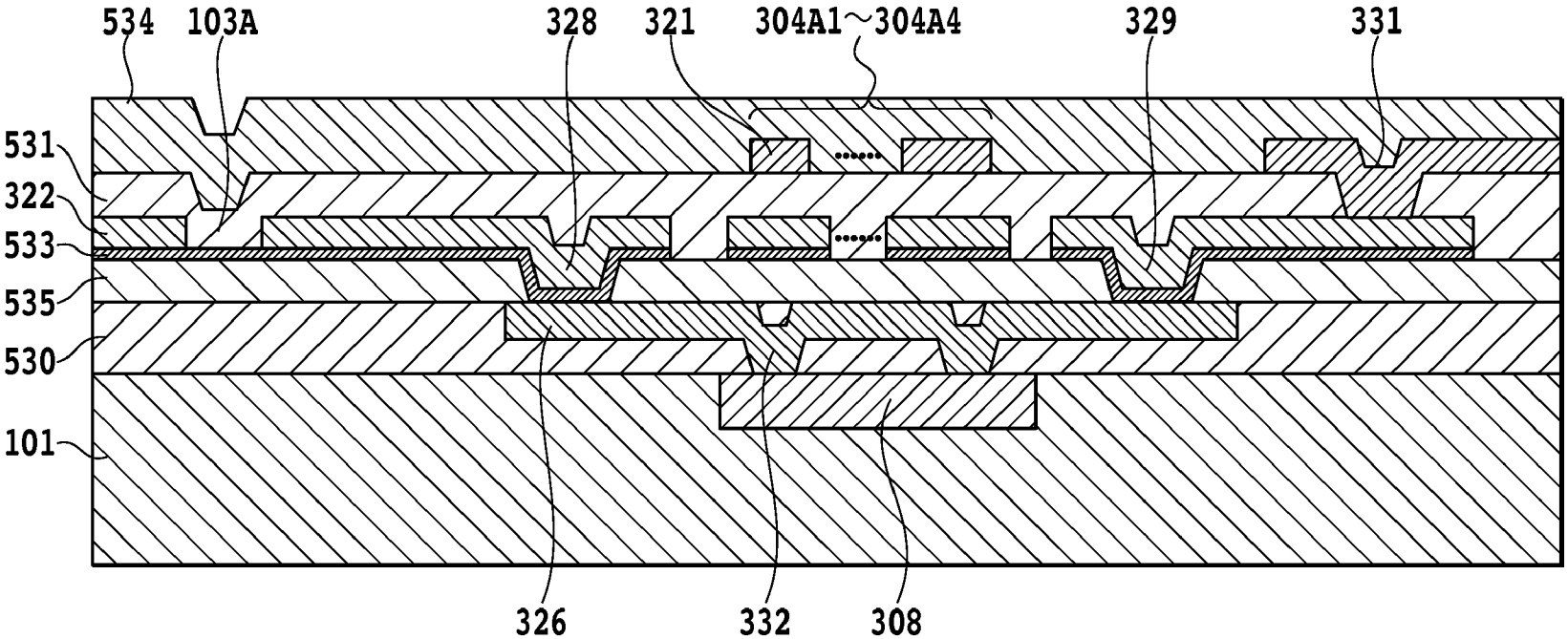
FIG. 14 is a cross-sectional view taken along the line XIV-XIV of FIG. 13.

Next, an ink jet print head substrate 130 as a fourth embodiment of this invention will be explained by referring to a plan view of FIG. 13 and a cross-sectional view of FIG. 14 taken along the line XIV-XIV of FIG. 13. In FIG. 13, parts identical with or equivalent to the corresponding parts of FIG. 4 are given like reference numbers and their detailed explanations are omitted.

In the print head substrate of this embodiment, wiring portions 103A2, 103B2 at one end of each of the first and second heater 103A, 103B are connected to the drive element 308. Thus, the second wiring layer 322 is connected via a through-hole 328 to the third wiring layer 326 disposed beneath the second wiring layer 322. The third wiring layer 326 is directly connected to the drive element 308.

In this embodiment, as described above, the heater layer 533 is formed simultaneously with the second wiring layer 322 and laid beneath the first wiring layer 321. The construction in which the heater layer is formed simultaneously with the second wiring layer, as described above, can have the similar effects to those of the preceding embodiments.

In the ink jet print head, possible methods to form a high resolution image by using increased dot densities include, for example, shortening distances between heaters in a direction of array or arranging the first and second heaters in a staggered relation. When heaters are arranged staggered, it is also possible to determine the relationship between the first wiring layer and the second wiring layer and the relationship between the first through-hole and the second through-hole, as in the preceding embodiments. In addition to an effect of enabling a high resolution image to be formed, the staggered arrangement of heaters can also be expected to produce an effect of forming an image with a high gradation, as in the preceding embodiments, thus forming an image of improved quality.

While, in plan views of the preceding embodiments, the first wiring layer is shown to be contained inside the second wiring layer, other configurations may be employed. For example, a configuration having the first wiring layer extending to the outside of the second wiring layer also has the similar effect.

Further, this invention has been explained to use two kinds of heaters capable of ejecting different volumes of ink. This invention, however, may also use three or more kinds of heaters capable of ejecting different volumes of ink. When three or more kinds of heaters are used, the same number of layers as that of heater kinds needs to be overlappingly formed one upon the other, with at least a part of the wiring leading to each kind of heater connected to different wiring layers. This configuration can significantly reduce an area occupied by the print head, compared to a conventional print head in which all heater wirings are formed in one plane. Furthermore, since currents supplied to heaters in each layer are prevented from affecting one another, there are no variations in voltage drop among the wiring portions connected to heaters. This in turn contributes to realizing a highly reliable ejection.

Further, the preceding embodiments have taken the side shooter type ink jet print head substrate for explanation. This invention is not limited to this type and can also be applied to a so-called edge shooter type print head in which ejection orifices for ejecting ink droplets are formed in a plane crossing a heater formation plane.

[Ink Jet Print Head]

Next, an embodiment of an ink jet print head according to this invention will be described.

Figure 15:
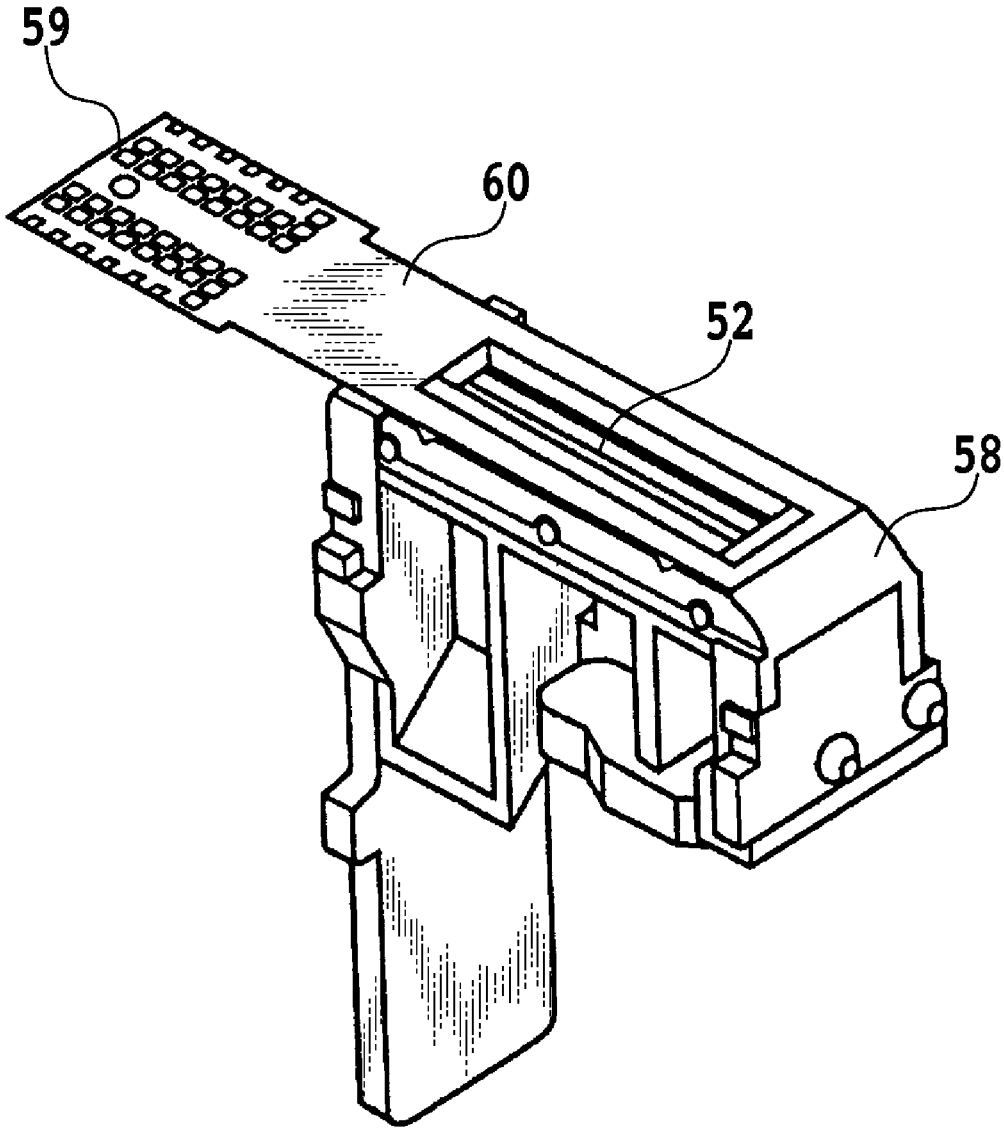
FIG. 15 is a perspective view showing an embodiment of the ink jet print head.
Figure 16:
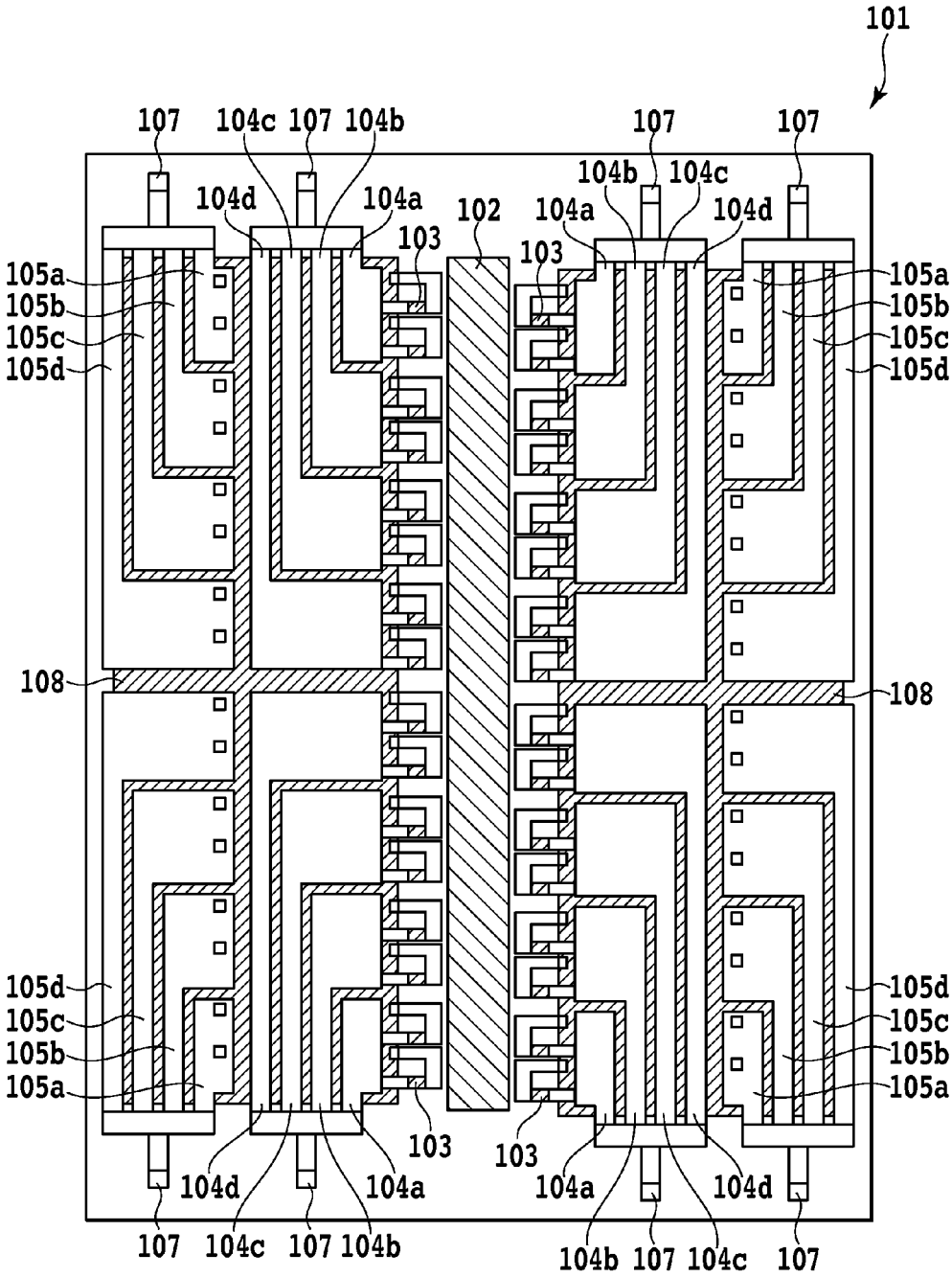
FIG.16 PRIOR ART
FIG. 16 is a plan view showing a conventional ink jet print head substrate.

FIG. 15 shows a construction of an ink jet print head incorporating the print head substrate 52 explained earlier. In FIG. 15, the print head substrate 52 is secured to a frame 58. On the print head substrate 52 is mounted a member 56 in which ejection orifices 122 and flow path are formed (see FIG. 1). A flexible printed circuit board 60 having a contact pad 59 to receive electric signals from the printer side is fixed to the frame 58. The flexible printed circuit board 60 supplies to the print head substrate 52 electric signals including drive signals sent from a control device in the printer body. Upon receiving the electric signals, the print head substrate 52 drives the heaters installed therein to eject ink droplets, large or small, from ejection orifices to print an image on a print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet print head substrate comprising:

a substrate having a surface;

a plurality of first energy generation elements configured to generate ejection energy used for ejecting ink droplet, and each of the first energy generation elements is provided so as to contact a pair of first electrodes, respectively;

a first power supply line including a first conductive single layer, the first power supply line supplying a power voltage to the plurality of first energy generation elements and the first conductive single layer connecting to one electrode of each of plurality of pairs of first electrodes;

a plurality of second ejection energy generation elements configured to generate ejection energy used for an ink droplet of a volume different from a volume of ink droplets ejected from the first ejection energy generation elements, each of the second energy generation elements being provided so as to contact a plurality of pairs of second electrodes;

a second power supply line including a second conductive single layer, the second power supply line supplying a power voltage to the second ejection energy generation elements and the second conductive single layer connecting to one electrode of each of the plurality of pairs of second electrodes; and an insulating single layer made of an insulating material, wherein the second conductive single layer, the insulating single layer, and the first conductive single layer are laminated, in this order, on the surface of the substrate.

2. The ink jet print head substrate according to claim 1, further comprising:

a first electrode pad connected to the first power supply line, the first electrode pad being used for applying the power voltage to the plurality of first ejection energy generation elements; and a second electrode pad connected to the second power supply line, the second electrode pad being used for applying the power voltage to the plurality of second ejection energy generation elements, wherein the first electrode pad and the second electrode pad allow for applying a voltage of substantially the same electrical potential.

3. The ink jet print head substrate according to claim 1, wherein most of the first power supply line are substantially provided so as to be located on the upper side of the second power supply line with respect to a direction perpendicular to the surface of the substrate.

4. The ink jet print head substrate according to claim 1, further comprising a protective single layer provided on the first conductive single layer with respect to a direction perpendicular to the surface of the substrate.

5. The ink jet print head substrate according to claim 1, wherein each of the first ejection energy generation elements and the second ejection energy generation elements is an electro-thermal conversion element, the electro-thermal conversion element including a heater layer configured to generate heat.

6. The ink jet print head substrate according to claim 5, wherein the pair of first electrodes and the pair of second electrodes are a part of the first conductive layer.

7. The ink jet print head substrate according to claim 1, wherein the pair of first electrodes and the pair of second electrodes are a part of the second conductive layer.

8. The ink jet print head substrate according to claim 1, further comprising:

an other insulating single layer provided underside of the second conductive single layer;

a driving circuit provided between the substrate and the other insulating single layer and to determine whether the first ejection energy generation elements and the second ejection energy generation elements are driven;

a plurality of first through holes passing through the insulating single layer; and a plurality of second through holes passing through the other insulating single layer.

9. The ink jet print head substrate according to claim 8, wherein each of the first ejection energy generation elements is electrically connected to the driving circuit via the first through hole and the second through hole, and wherein each of the second ejection energy generation element elements is connected to the driving circuit through the first through hole and the second through hole.

10. The ink jet print head substrate according to claim 9, wherein the second through hole provided for electrically connecting each of the first ejection energy generation elements to the driving circuit is disposed closer to the driving circuit than the first through hole provided for electrically connecting each of the second energy ejection generation elements to the driving circuit with respect to a direction parallel to the surface of the substrate.

11. The ink jet print head substrate according to claim 8, wherein each of the first ejection energy generation elements is electrically connected to the driving circuit through the second through hole, and each of the second ejection energy generation elements is electrically connected to the driving circuit through the second through hole, and wherein each of the first ejection energy generation elements is electrically connected to the first power supply line through the first through hole.

12. The ink jet print head substrate according to claim 1, wherein the plurality of the first ejection energy generation elements and the plurality of second ejection energy generation elements are arranged alternately in one column.

13. An ink jet print head, comprising:

the ink jet print head substrate according to claim 1; and a member comprising a plurality of ink ejection orifices;

wherein ink droplets are ejected from the ink ejection orifices by driving the first ejection energy generation elements and the second ejection energy generation elements.

14. The ink jet print head substrate according to claim 1, further comprising:

a first ground line including a third conductive single layer, the first ground line grounding to the plurality of first energy generation elements and the third conductive single layer connecting to the other electrode of each of the plurality of pairs of first electrodes; and a second ground line including a fourth conductive single layer, the second ground line grounding to the plurality of second ejection energy generation elements and the fourth conductive single layer connecting to the other electrode of each of a plurality of the pairs of second electrodes; and wherein the fourth conductive single layer, the insulating single layer, and the third conductive single layer are laminated, in this order, on the surface of the substrate.

* * * * *